US006020565A

United States Patent [19]

Pan

[11] Patent Number: 6,020,565

[45] Date of Patent: Feb. 1, 2000

[54] LOW-MOUNTING FORCE KEYSWITCH

[75] Inventor: Hua-Tseng Pan, Taipei, Taiwan

[73] Assignee: Hon Hai Precision Ind. Co., Ltd., Taipei Hsien, Taiwan

[21] Appl. No.: 09/218,719

[22] Filed: Dec. 22, 1998

[30] Foreign Application Priority Data

May 22, 1998 [TW] Taiwan ..... 87208047

[51] Int. Cl.[7] ..... H01H 3/12; H01H 13/70

[52] U.S. Cl. ..... 200/344; 200/345

[58] Field of Search ..... 200/344, 345

[56] References Cited

U.S. PATENT DOCUMENTS 4,902,862 2/1990 Oelsch et al. ..... 200/344
5,278,371 1/1994 Watanabe et al. ..... 200/344
5,457,297 10/1995 Chen ..... 200/344
5,758,763 6/1998 Sanda et al. ..... 200/344

*Primary Examiner*—J. R. Scott

[57] ABSTRACT

A keyswitch for use with a keyboard comprises a base forming at least a pair of mounting sockets. A first sliding member is movably assembled to one of the mounting sockets. The first sliding member is formed with a slide at a free end thereof. A second sliding member is movably assembled to another of the mounting sockets. The second sliding member is formed with a slide at a free end thereof. Hinging means is arranged between the first and second sliding members and includes at least a sliding groove defined in one of the first and second traversal rods, and a bud formed on one another of the first and second traversal rods corresponding to the sliding groove. A keycap defines a depressing face and a peripheral flange extending from edges of the depressing face. At least a pair of sliding slots are defined in corners of the depressing face for movably receiving the slides of the first and second sliding members.

4 Claims, 6 Drawing Sheets

LOW-MOUNTING FORCE KEYSWITCH

FIELD OF THE INVENTION

The present invention relates to a keyswitch, and more particularly to a low-depression force keyswitch for facilitating quick assembly.

DESCRIPTION OF THE PRIOR ART

Keyboards are common input devices for data processing equipment. A keyboard is configured with a plurality of keyswitches. Conventionally, keyswitches are manually assembled to an array of openings. In light of this, production speed can only be increased with low-mounting-force keyswitches. Furthermore, durability of each keyswitch is critical for proper data input. As a result, an ideal keyswitch is easily mounted to the base frame, while removed therefrom is difficult.

Referring to FIGS. 1 and 2, a keycap 40, stoppers 70, and keycap flanges 46 provide a sliding area. The stopper 70 is a thin, rectangular plate. Slides 52, 62 of the sliding members 50, 60 are movably received within the sliding area. The positions of the slides 52, 62 vary as the sliding members 50, 60 move. FIG. 1 shows the positions of the slides 52, 62 before the keycap 40 is assembled thereto. FIG. 2 shows the positions of the slides 52, 62 after the keycap 40 is removed therefrom.

The assembly/removal force for the keycap 40 depends on the length of the slides 52, 62 within the stoppers 70. Accordingly, when a span between the stoppers 70 is fixed (length B shown in FIG. 1), selecting a suitable total length of the slides 52, 62 becomes a difficult issue. If the length is too long, the keycap becomes difficult to assemble. However, if the length is too short, the keycap will be easily removed from a base frame. Additionally, the assembly/removal force and removal force can also be affected by clearance which varies during a molding process.

Taiwan Utility Patents 80206310, 83204123, 84214256, 85202834, and U.S. Pat. Nos. 5,463,195, 5,504,283, 5,512,719 disclose pertinent techniques. However, the problem mentioned above is still unsolved.

SUMMARY OF THE INVENTION

An objective of this invention is to provide a keyswitch having a keycap defining a plurality of sliding slots in which corresponding linkages of slides are movably assembled thereby providing a low-assembly force and a high removal force.

In order to achieve the objective set forth, a keyswitch for use with a keyboard comprises a base forming at least a pair of mounting sockets. A first sliding member is movably assembled to one of the mounting sockets. The first sliding member is formed with a slide at a free end thereof. A second sliding member is movably assembled to another of the mounting sockets. The second sliding member is formed with a slide at a free end thereof. Hinging means is arranged between the first and second sliding members and defines at least a sliding groove in on one of the first and second traversal rods, and forms a bud on another of the first and second traversal rods corresponding to the sliding groove. A keycap defines a depressing face and a peripheral flange extending from edges of the depressing face. At least a pair of sliding slots are defined in corners of the depressing face for movably receiving slides of the first and second sliding members.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 6:
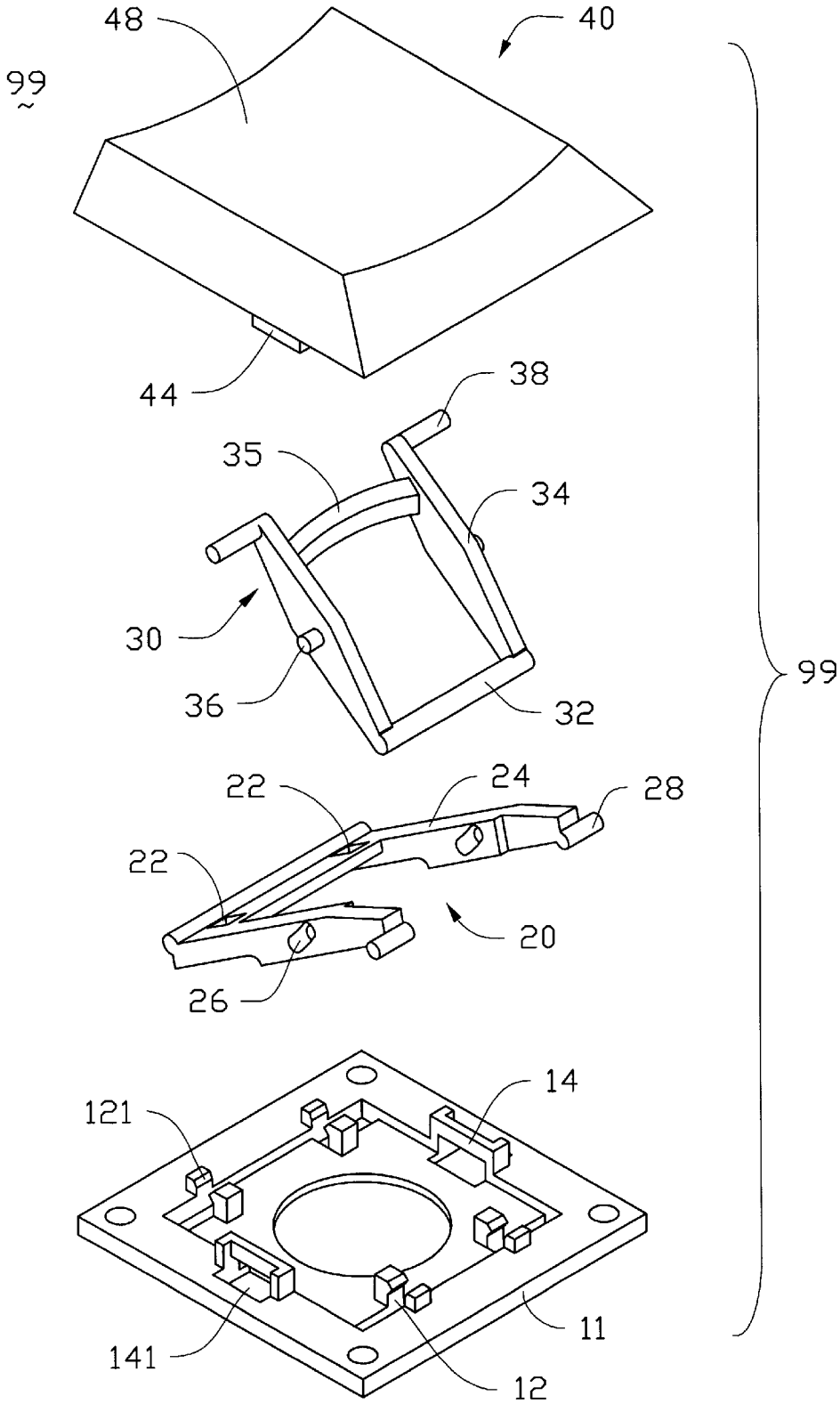
FIG. 6 is an exploded view of a keyswitch in accordance with the present invention.

Referring to FIG. 6, a keyswitch 99 in accordance with the present invention comprises a base 11, a first slide 20, a second slide 30, and a keycap 40. The base 11 is a rectangular plate forming a mounting socket 12 at both sides. Each socket 12 is configured by a pair of retaining posts 121. The base 11 further forms guiding portions 14 on central portions of opposite sides thereof. Each guiding portion 14 is provided with a guiding slot 141. The first sliding member 20 has a U-shaped configuration including a pair of traversal rods 24 connected by a pivotable portion 22 which is pivotably received within the socket 12. Each rod 24 is further provided with a sliding groove 26 on an inner side thereof. Each groove 26 is provided with a suitable curved portion. A first slide 28 is formed on a free end of each rod 24.

The second sliding member 30 has the same configuration as the first sliding member 20 and includes a pair of traversal rods 34 connected by a pivotable portion 32 which is movably received within another socket 12. Each traversal rod 34 is formed with a bud 36 for movably engaging with the sliding groove 26 of the first sliding member 20. Each rod 34 further includes a second slide 38 at a free end thereof. A reinforced rib 35 is bridged between the rods 34 to increase the rigidity of the second slide 30.

Figure 1:
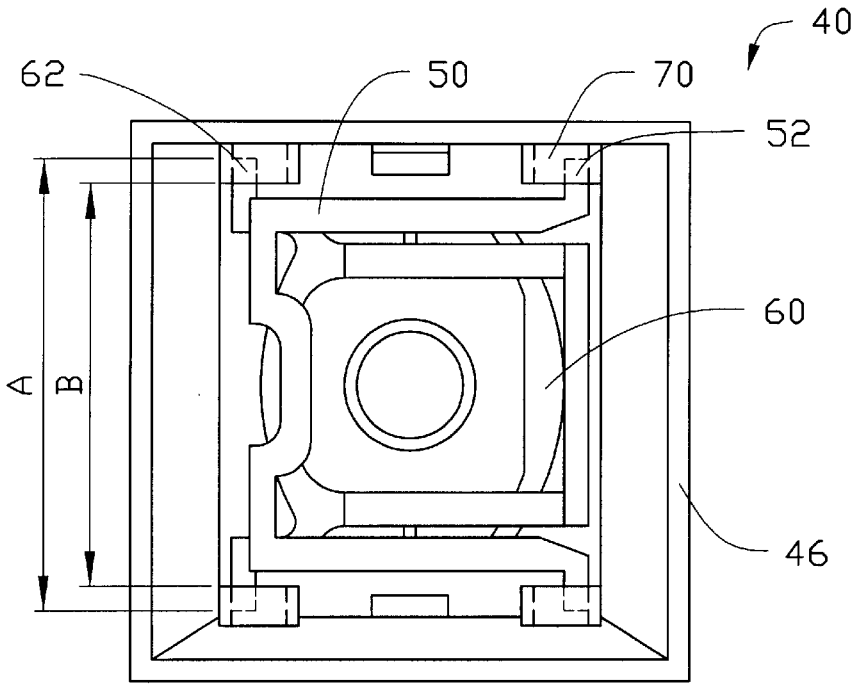
FIG.1 (PRIOR ART)
FIG. 1 is a top view of a conventional keyswitch in which a keycap is assembled.
Figure 2:
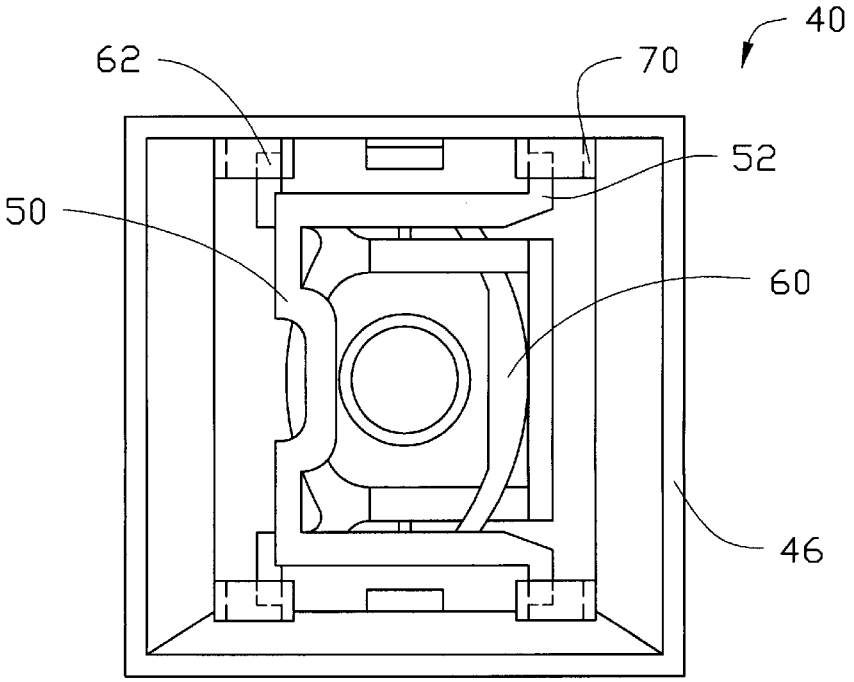
FIG.2 (PRIOR ART)
FIG. 2 is a top view of FIG. 1 in which the keycap is removed.
Figure 3:
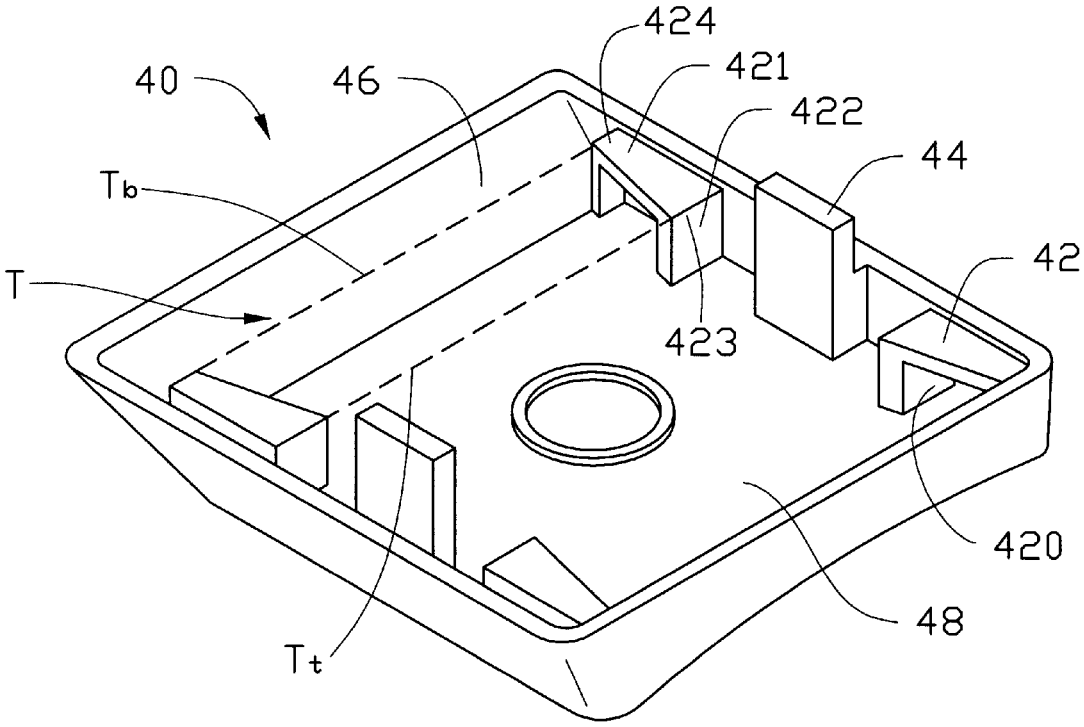
FIG. 3 is a perspective view of a keycap in accordance with the present invention.
Figure 4:
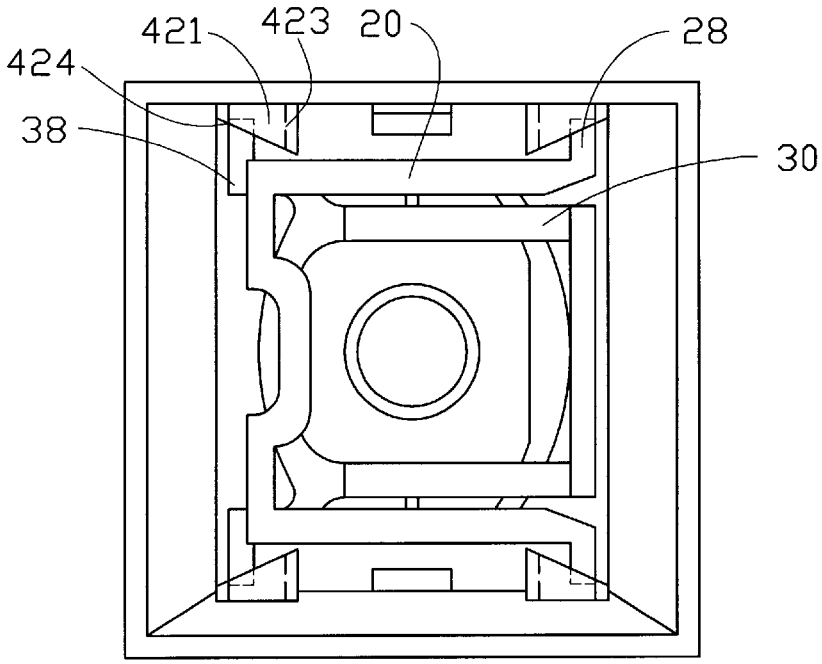
FIG. 4 is a top view of a keyswitch in accordance with the present invention when a keycap is assembled.
Figure 5:
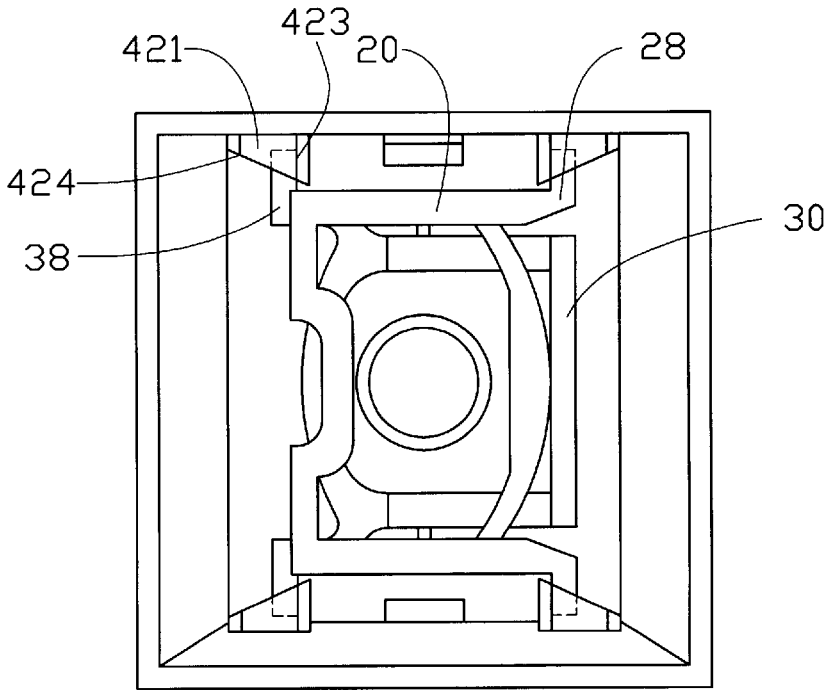
FIG. 5 is a top view of FIG. 4 when the keycap is removed.
Figure 7:
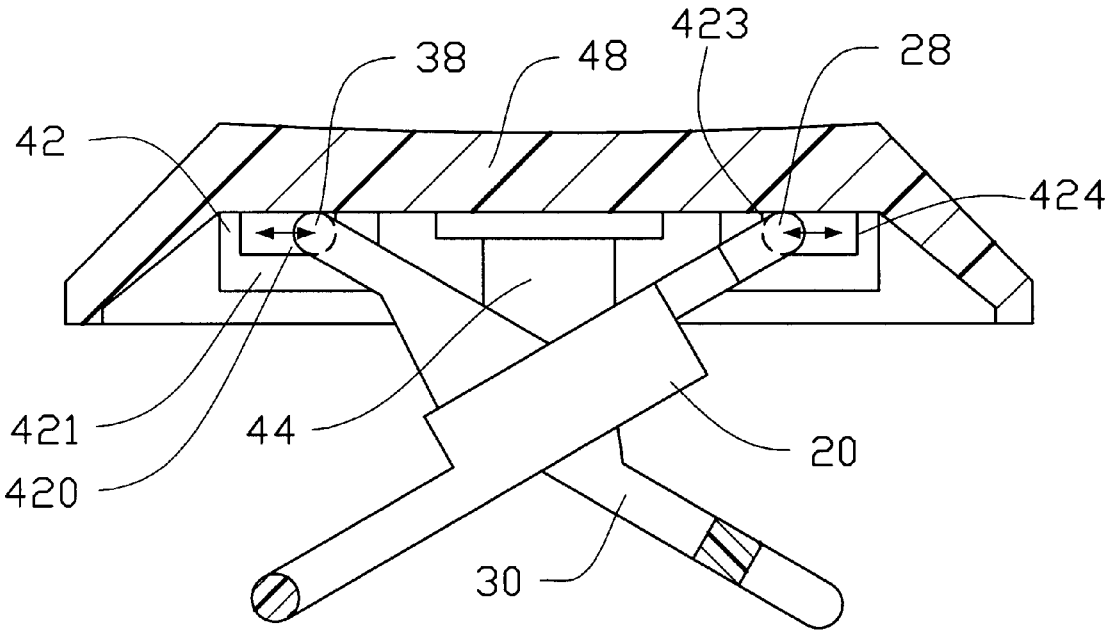
FIG. 7 is a side elevational view of FIG. 4.

Referring to FIG. 3, the keycap 40 defines a depressing face 48 for receiving a depressing force. The keycap 40 forms a pair of guiding posts 44 on opposite sides thereof and defines a U-shaped sliding slot 42 in each corner. The U-shaped sliding slot 42 is defined by a horizontal plate 421 and a vertical plate 422 both having a trapezoidal shape. By the provision of the trapezoidal horizontal plate 421, a trapezoidal space T (marked with a dotted line) is defined between opposite sliding slots 42. The trapezoidal space T features a wide bottom Tb and a narrow top Tt. The vertical plate 422 is connected with the keycap 48. Each U-shaped sliding slot 42 defines an entrance 420 for receiving the first and second slides 28, 38 of the corresponding first and second sliding members 20, 30 as seen in FIG. 7. By this arrangement, when the keycap 40 is depressed, not only will the bud 36 of the second sliding member 30 move along the sliding groove 26 of the first sliding member 20, but the first and second slides 28, 38 will also move horizontally along the U-shaped sliding slots 42 of the keycap 40. When the keycap 40 reaches the highest point (start of removal force), the first and second slides 28, 38 are located at the widest position 423 of the horizontal plate 421 of the U-shape sliding slot 42, as shown in FIG. 5. At this stage, it has the longest engaging length which benefits the strongest anti-removal force. When the keycap 40 reaches the lowest position (FIG. 4), the slides 28, 38 are located at the narrowest position 424 of the horizontal plate 421 featuring the lowest assembly force.

Figure 8:
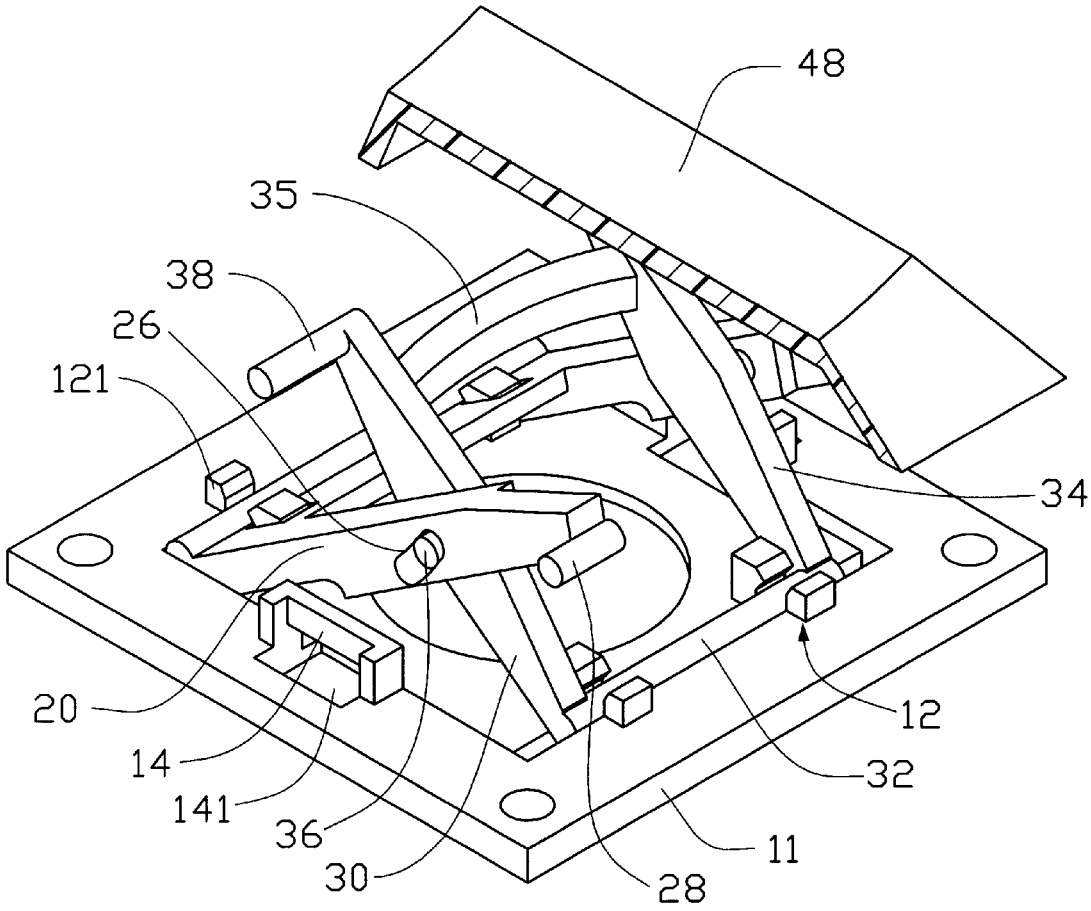
FIG. 8 is a partial assembled view of FIG. 4.

FIG. 8 shows the sliding members 20, 30 are assembled to the socket 12 of base 11. The keycap 48 is partially cut off for clearly description.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A keyswitch for use with a keyboard, comprising:

a base forming at least a pair of mounting sockets and a guiding portion;

a first sliding member movably assembled to one of said mounting sockets, said first sliding member including a pair of first traversal rods connected by a first connecting portion, each traversal rod being formed with a first slide at a free end thereof;

a second sliding member movably assembled to another of said mounting sockets, said first sliding member including a pair of second traversal rods connected by a second connecting portion, each second traversal rod being formed with a second slide at a free end thereof, said second sliding member being pivotably assembled to said first sliding member such that said second slide is opposite to said first slide;

hinging means arranged between said first and second sliding members, said hinging means including at least a sliding groove defined on one of said first and second traversal rods, and a bud formed on another of said first and second traversal rods corresponding to said sliding groove; and a keycap defining a depressing face and a peripheral flange extending from edges of said depressing face, at least a guiding post extending from said peripheral flange and moveably received in said guiding portion, at least a pair of sliding slots defined in opposite corners of said depressing face for movably receiving first and second slides of said first and second sliding members, respectively.

2. The keyswitch as recited in claim 1, wherein said sliding slots are configured by a trapezoidal horizontal plate and a vertical plate, said trapezoidal plate having a wide side adjacent to a center of said keycap, and a narrow side adjacent to said flange.

3. A keyswitch for use with a keyboard, comprising:

a base forming a pair of mounting sockets;

a pair of sliding members pivotally mounted to the mounting sockets, respectively;

each of said sliding members including at least a slide at a distal end thereof; and a keycap adapted to be moved up and down with regard to the base in a vertical direction and defining a depressing face and at least a pair of sliding slots around a undersurface of the depressing face each for movably receiving the corresponding slide of the corresponding sliding member and allowing said slide to move in a first horizontal direction; wherein when the keycap is in an upper position and the slide is closer to a center of the keycap, a dimension of said sliding slot along a second horizontal direction which is perpendicular to both said first direction and said vertical direction, is larger than that of a situation that the keycap is in a lower position and the slide is relatively farther away from the center of the keycap, thereby providing a low-assembling force and a high removal force of the keycap with regard to the base.

4. A keyswitch for use with a keyboard, comprising:

a base and a keycap supportably connected to base through a pair of sliding members, said keycap adapted to move up and down with regard to the base and be in either an upper or a lower position; and each of said sliding members including a first end pivotally mounted to one of said base and keycap, and an opposite second end slidably mounted to the other of said base and keycap, said first end including a horizontal slide; wherein said one of the base and keycap defines a horizontal sliding slot having variable transverse positions along a sliding direction when the slide slidably moves within the sliding slot, and wherein the slide is engaged in the sliding slot with thereof a shorter axial position measured from a distal end of said slide when the keycap is in a lower position, while the slide is engaged in the sliding slot with thereof a longer axial position measured from said distal end of the slide when the keycap is in an upper position.

* * * * *